US006951203B2

(12) United States Patent
Spaulding

(10) Patent No.: US 6,951,203 B2
(45) Date of Patent: Oct. 4, 2005

(54) IGNITION TIMING CONTROL SYSTEM

(75) Inventor: Greg Spaulding, Newfolden, MN (US)

(73) Assignee: Arctic Cat Inc., Thief River Falls, MN (US)

( * ) Notice: Subject to any disclaimer, the term of this patent is extended or adjusted under 35 U.S.C. 154(b) by 0 days.

(21) Appl. No.: 10/454,861

(22) Filed: Jun. 5, 2003

(65) Prior Publication Data

US 2004/0244774 A1 Dec. 9, 2004

(51) Int. Cl.[7] ..... F02P 5/00
(52) U.S. Cl. ..... 123/406.44; 123/406.55
(58) Field of Search ..... 123/406.44, 406.55, 123/295, 305, 435; 60/285, 274, 276, 284

(56) References Cited

U.S. PATENT DOCUMENTS

| | | | | |
|---|---|---|---|---|
| 5,050,551 | A | 9/1991 | Morikawa | 123/305 |
| 5,613,360 | A | 3/1997 | Iwai et al. | |
| 5,749,333 | A | 5/1998 | Duret | |
| 6,237,566 | B1 | 5/2001 | Spaulding | 123/406.44 |
| 6,550,450 | B2 | 4/2003 | Spaulding | 123/406.44 |
| 2002/0152990 | A1 | 10/2002 | Spaulding | |

FOREIGN PATENT DOCUMENTS

| | | |
|---|---|---|
| WO | WO 94/17293 | 8/1994 |

*Primary Examiner*—Mahmoud Gimie
(74) *Attorney, Agent, or Firm*—Merchant & Gould P.C.

(57) ABSTRACT

A method for improving engine performance, by increasing fuel efficiency and/or power output, and/or by decreasing the output of pollutants. When the temperature of the engine's exhaust system is lower than a target temperature, the ignition position of the cylinders of the engine is changed such that fuel and air propagate from the cylinders into the exhaust system while undergoing combustion. The heat from the combustion of the fuel and air in the exhaust system increases the temperature of the exhaust system. The ignition position may be retarded from the normal operating ignition position by up to 40 degrees or more, or to 10 to 20 degrees after top dead center. The ignition position may be changed manually or automatically. The exhaust temperature may be sensed and displayed. An engine control system for improving engine performance includes an ignition changing mechanism to change the ignition position of the cylinders, and an activating mechanism for activating the ignition changing mechanism. The system may also include an exhaust sensing mechanism for sensing the temperature of the exhaust system, a display mechanism for displaying an indication of the exhaust system temperature, a comparing mechanism for comparing the temperature to other data, and a control mechanism for controlling the ignition changing mechanism based on the results of the comparison.

50 Claims, 5 Drawing Sheets

IGNITION TIMING CONTROL SYSTEM

BACKGROUND OF THE INVENTION

1. Field of the Invention

The invention relates to a system for controlling the timing of ignition in an engine. More particularly, the invention relates to a system for changing the timing of an engine so as to heat an exhaust system connected to the engine.

2. Description of Related Art

Vehicles, such as snowmobiles, conventionally include an engine such as an internal combustion engine in order to enable them to move under their own power. In particular, two cycle engines are used in a variety of vehicles because of their high power to weight ratio, simplicity, etc.

It is known to design the exhaust system for such a vehicle so that it is "tuned", such that the harmonic characteristics of the exhaust system allow for increased power and fuel efficiency, and reduced engine emissions.

Conventional tuned exhaust systems have limitations. For example, the harmonic characteristics of an exhaust system depend in part on the temperature of the exhaust system. Thus, an exhaust system normally can be fully tuned only for a narrow range of temperatures. Conventionally, an exhaust system is tuned for what is expected to be the typical sustained operating temperature for a particular vehicle.

However, when the engine in a conventional vehicle is started, the temperature of the exhaust system typically does not begin at the normal operating temperature. If the exhaust system is significantly colder than the normal operating temperature, for which it has been tuned, the exhaust system will be out of tune.

Thus, an engine that is started cold does not receive the benefits of a tuned exhaust system. Consequently, the power and fuel efficiency of the engine may be reduced until the exhaust system warms, and the engine emissions likewise may be increased.

Furthermore, even if an engine has been started, and has been allowed to run for a significant period of time while the vehicle is stationary, the engine heat generated may not be sufficient to heat the exhaust system to its normal operating temperature. In practice, exhaust systems in conventional vehicles do not reach normal operating temperature until the vehicle has been moving for some period of time; idling or revving the engine without moving the vehicle often is not sufficient. Thus, even if the engine is running, the exhaust system may remain out of tune until the vehicle has traveled a significant distance.

The limitations of conventional systems with regard to exhaust tuning are of particular importance in conditions where a vehicle must start from a standstill, and achieve high speeds in a short time, for example when racing.

Likewise, the limitations of conventional systems may be especially pronounced in cold conditions, such as those under which snowmobiles commonly are used, since at colder ambient temperatures the difference between the actual temperature of the exhaust system and the tuned temperature may be significantly greater.

A brief description of the operation of a conventional engine may be helpful in understanding the present invention.

FIG. 1 shows a conventional two-cycle engine 10, as known from the prior art. As shown, the engine 10 includes a crank case 13 and at least one cylinder 12 with a cylinder wall 26 and a cylinder head 14. A piston 16 is movably disposed within the cylinder 12. The engine 10 also defines an intake port 30 that allows an ingoing mixture 38 to enter the engine 10, a transfer port 31 that allows the incoming mixture 36 to move from the crank case 13 to the cylinder 12, and an exhaust port 32 that allows an outgoing mixture 38 to exit the engine 10.

The piston 16 and a crank web 20 are connected with a connecting rod 18 such that the connecting rod 18 pivots where it attaches to both the piston 16 and the crank web 20. Thus, as the piston 16 moves up and down in the cylinder 12, the crank web 20 is made to turn about its axis of rotation 22. Typically, a crank shaft (not shown) is connected to the crank web 20 at the axis of rotation 22, the crank shaft carrying the power to the vehicle's drive system.

FIG. 1A shows the engine 10 with the piston 16 in its uppermost position, also referred to as "top dead center". For purposes of the following description, top dead center will also be considered to be 0 degrees with respect to a circular path traveled by the end of the connecting rod.

In the top dead center position, both the transfer port 31 and the exhaust port 32 of the engine 10 are blocked by the piston 16. Matter cannot enter or exit the cylinder 12 through either port.

From top dead center, the piston 16 moves downward as shown in FIG. 1B. In the position shown, the engine is 90 degrees after top dead center. The exhaust port 32 is unobstructed in this position, and the outgoing mixture 38 exits the cylinder 12 therethrough. Conventionally, the outgoing mixture 38 for a two-cycle engine includes the combustion products from the engine's fuel and oil, and oxygen-depleted air. The outgoing mixture moves from the exhaust port 32 toward the exhaust system (not shown).

The piston 16 continues to move downward as shown in FIG. 1C. In the position shown, the engine is 180 degrees after top dead center. This position also may be considered to be 180 degrees before top dead center, and is sometimes referred to as "bottom dead center". The exhaust port 32 is still unobstructed in this position, and the outgoing mixture 38 may continue to exit the cylinder 12 therethrough. In addition, the transfer port 31 is now unobstructed, allowing an incoming mixture 36 to pass therethrough from inside the crank case 13. Conventionally, the incoming mixture 36 for a two-cycle engine includes fuel, oil, and air.

The piston 16 then moves upward as shown in FIG. 1D. In the position shown, the engine is 90 degrees before top dead center. The exhaust port 32 is still unobstructed in this position, and the outgoing mixture 38 may continue to exit the cylinder 12 therethrough. However, the transfer port 31 is now obstructed, so no more incoming mixture 36 may enter the cylinder 12 therethrough. In addition, at this point an intake valve 33 opens at the intake port 30, allowing the incoming mixture 36 to be drawn into the crank case 13.

Conventionally, at some point before top dead center, the fuel and air in the cylinder 12 are ignited by the igniter 24. As illustrated in FIG. 1E, the igniter 24 includes a spark plug that produces a spark 34.

In the position shown in FIG. 1E, both the exhaust port 32 and the transfer port 31 are obstructed by the piston 16, and matter may not pass through either port. In addition, the reed valve 33 commonly is closed at this point, preventing any more of the incoming mixture 36 from being drawn into the crank case 13. When the cylinder 12 ignites, fuel combusting within the cylinder 12 generates pressure that drives the piston 16 downward again, repeating the cycle from FIG. 1A.

Thus, as shown in FIG. 1E, the position at which ignition conventionally occurs, referred to herein as the operating ignition position, occurs before the engine 10 reaches top dead center. As illustrated, the position is 15 degrees ahead of top dead center. The engine angle of the operating ignition position may vary somewhat depending upon the particular design of the engine 10. Likewise, the engine angle of the operating ignition position may vary somewhat during operation depending on conditions such as engine speed. However, conventionally ignition occurs significantly ahead of top dead center.

SUMMARY OF THE INVENTION

It is the purpose of the claimed invention to overcome these difficulties, thereby providing an improved arrangement for heating a vehicle exhaust system. An exemplary embodiment of a method of improving engine performance in accordance with the principles of the claimed invention includes the step of igniting a cylinder of an engine at a warming ignition position when the temperature of the exhaust system is lower than a target temperature. In the warming ignition position, burning fuel and air propagate from the cylinder to the exhaust system. The heat from the burning fuel and air passing into the exhaust system causes the temperature of the exhaust system to increase towards its target temperature. The cylinder is then ignited at an operating ignition position when the temperature of the exhaust system is at least equal to the target temperature. While the cylinder is being ignited at the operating position, the performance of the engine when the temperature of the exhaust system is at least equal to the target temperature is improved over its performance when the temperature of the exhaust system is less than the target temperature.

The warming ignition position may be retarded from the ignition position during normal operation of the engine.

As the term is used herein, "normal operation" of an engine is considered to encompass engine operation wherein action is not taken to pass combusting fuel and air from the engine cylinders into the exhaust system. Thus, normal operation includes, but is not limited to, idling the engine and using it to generate power for moving a vehicle.

The warming ignition position may be retarded by a range of values, i.e. up to 5 degrees, at least 5 degrees, at least 10 degrees, at least 15 degrees, at least 20 degrees, at least 25 degrees, at least 30 degrees, at least 35 degrees, or at least 40 degrees.

Alternately, as measured with regard to the engine orientation, the warming ignition position when heating the exhaust system may be 10 to 20 degrees after top dead center.

The ignition position may be changed manually or automatically. The temperature of the exhaust system may be measured, and may be displayed to the vehicle operator. For automatic changes, the temperature may be compared to a comparison value, and then automatically adjusted appropriately so as to bring the exhaust system to the desired operating temperature.

The engine may have two or more cylinders. In such cases, the cylinders may be ignited independently from one another.

An exemplary embodiment of an engine control system in accordance with the principles of the claimed invention includes an ignition changer in communication with the igniter for the engine. The ignition changer changes the ignition position of at least one cylinder of the engine to and from a warming ignition position. In the warming ignition position, burning fuel and air propagate from the cylinder to the exhaust system, warming the exhaust system. The control system also includes an activator for activating the ignition changer. The activator is in communication with the ignition changer.

The activator may be manual or automatic.

The control system may include an exhaust sensor for sensing the temperature of the exhaust system. The control system also may include a display for displaying the temperature of the exhaust system.

For embodiments having an automatic activator, the system may include a comparator in communication with the exhaust sensor. The comparator compares the temperature of the exhaust system with at least one comparison value. The system also may include a control system in communication with the comparator and the ignition changer. The control system automatically controls ignition position in response to the comparison of the exhaust temperature with the comparison value, so as to automatically reach and maintain the target temperature for the exhaust system.

For embodiments wherein the engine has at least two cylinders, the igniter may be adapted to ignite each of the cylinders independently from one another. In such embodiments, the ignition changer may be adapted to change the ignition position for each of the cylinders.

An exemplary method of operating an engine in accordance with the principles of the claimed invention includes the step of igniting a cylinder of the engine at a warming ignition position of the piston within the cylinder. In the warming ignition position, burning fuel and air propagate from the cylinder to the exhaust system, warming the exhaust system towards a target temperature. The method also includes the step of subsequently igniting the cylinder at an operating ignition position that is different from the warming ignition position.

An exemplary embodiment of an engine assembly in accordance with the principles of the claimed invention includes an engine. The engine in turn includes at least one cylinder, a piston disposed within the cylinder, and an igniter for igniting fuel and air within the cylinder. The engine assembly also includes an exhaust system in communication with the cylinder, and an engine control system. The engine control system includes an ignition changer for changing the ignition position of the piston to and from a warming ignition position. The ignition changer is in communication with the igniter. In the warming ignition position burning fuel and air propagate from the cylinder to the exhaust system, warming the exhaust system. The engine control system also includes an activator in communication with the ignition changer for activating the ignition changer.

BRIEF DESCRIPTION OF THE DRAWINGS

Like reference numbers generally indicate corresponding elements in the figures.

DETAILED DESCRIPTION OF THE PREFERRED EMBODIMENT

Figure 2:
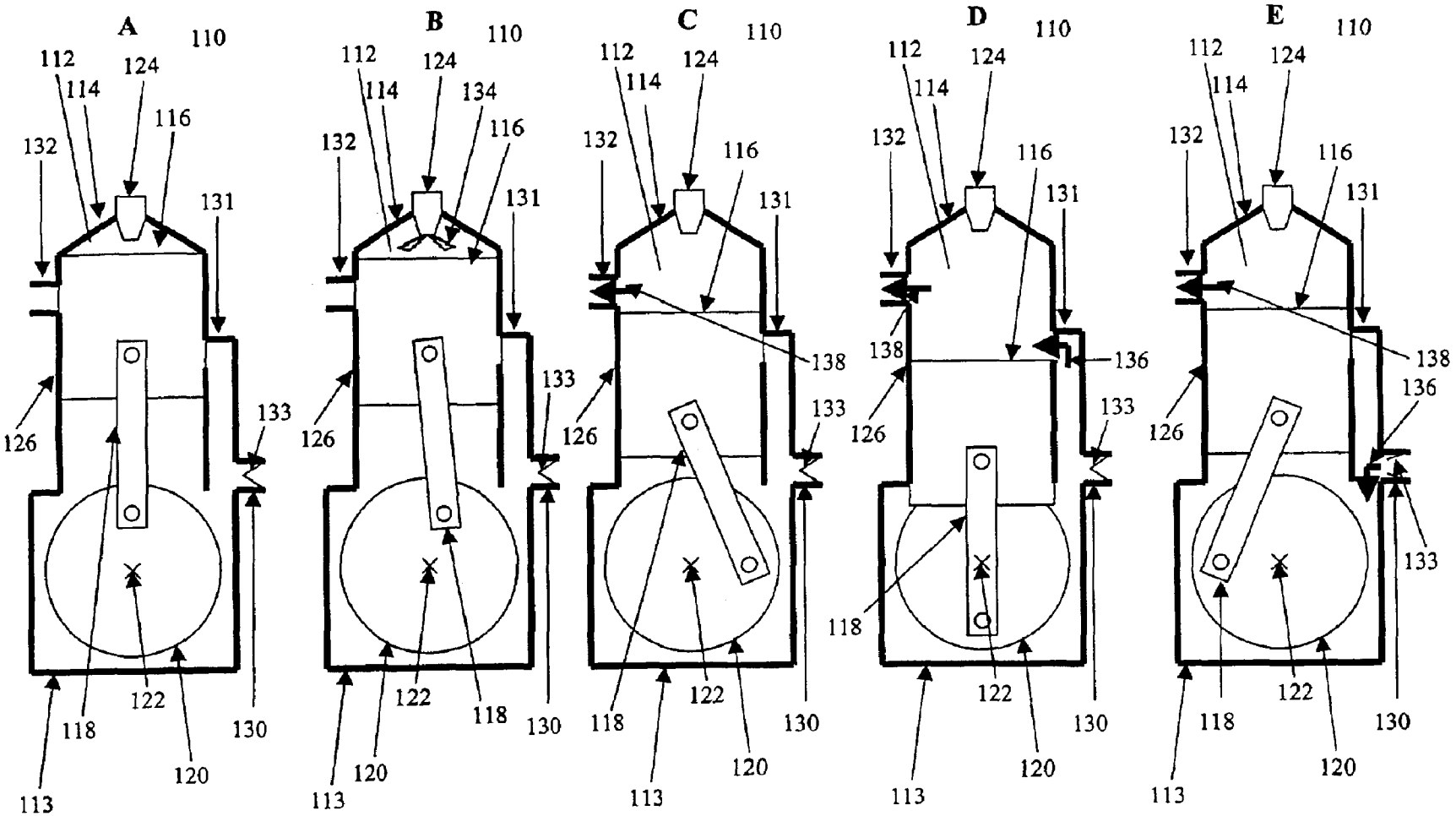
FIG. 2 shows in schematic form the ignition sequence for a two-cycle engine under the control of an exemplary embodiment of an engine control system in accordance with the principles of the present invention.

FIG. 2 shows the ignition sequence for a two-cycle engine 110 under the control of an exemplary embodiment of an engine control system in accordance with the principles of the present invention.

As shown, the engine 110 includes at least one cylinder 112 with a cylinder wall 126 and a cylinder head 114. A piston 116 is movably disposed within the cylinder 112. The engine 110 also defines an intake port 130 that allows an ingoing mixture 138 to enter the engine 110, a transfer port 131 that allows the incoming mixture 136 to move from the crank case 113 to the cylinder 112, and an exhaust port 132 that allows an outgoing mixture 138 to exit the engine 110.

The piston 116 and a crank web 120 are connected with a connecting rod 118 such that the connecting rod 118 pivots where it attaches to both the piston 116 and the crank web 120, so that as the piston 116 moves up and down in the cylinder 112, the crank web 120 turns about its axis of rotation 122.

FIG. 2A shows the engine 110 with the piston 116 at top dead center. Both the transfer port 131 and the exhaust port 132 of the engine 110 are blocked by the piston 116. Matter cannot enter or exit the cylinder 112 through either port.

At some point after top dead center, the fuel and air in the cylinder 112 are ignited by the igniter 124. As illustrated in FIG. 2B, the igniter 124 includes a spark plug that produces a spark 134. However, this is exemplary only. Other igniters, including but not limited to glow plugs, may be equally suitable. In addition, it is noted particularly that the igniter 124 may include other components, such as an ignition coil for activating the spark plug, glow plug, etc.

Regardless, as shown in FIG. 2B, ignition occurs after top dead center. As illustrated, the ignition position is approximately 15 degrees. This angle is exemplary only, and may vary as described below in more detail.

In the position shown in FIG. 2B, both the exhaust port 132 and the transfer port 131 are obstructed by the piston 116, and matter may not exit through either port. The fuel combusting within the cylinder 112 generates pressure that drives the piston 116 downward.

The piston 116 continues to moves downward as shown in FIG. 2C. In the position shown, the engine is 90 degrees after top dead center. The exhaust port 132 is unobstructed in this position, and an outgoing mixture 138 exits the cylinder 112 therethrough.

Figure 1:
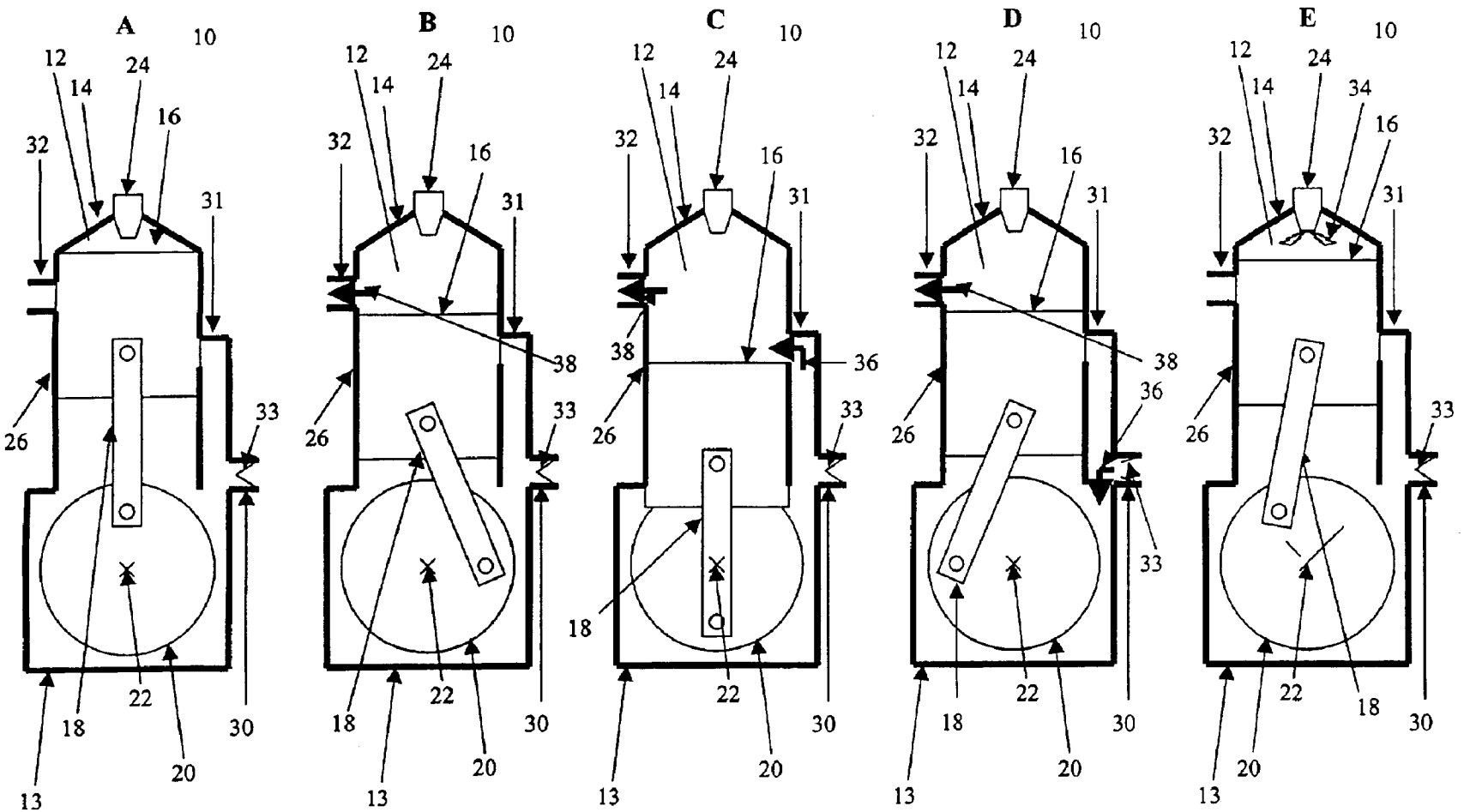
Fig. 1 PRIOR ART
FIG. 1 shows in schematic form the ignition sequence for a conventional two-cycle engine, as known from the prior art.

Thus, in contrast to the conventional arrangement described with regard to FIG. 1, according to the principles of the present invention ignition takes place after top dead center, as shown in FIG. 2B. As noted previously, the operating ignition position for an engine conventionally is ahead of top dead center, as shown in FIG. 1E. As may be seen from FIG. 2, because according to the present invention the ignition position is retarded from the operating ignition position, there is less time for combustion to take place between ignition in FIG. 2B and the point at which the exhaust port 132 is open in FIG. 2C.

As a result, the outgoing mixture 138 is still undergoing combustion as it is exiting the cylinder 112 through the exhaust port 132. The outgoing mixture 138 typically includes both burned and unburned fuel and oil, as well as air that is partially oxygen-depleted. The outgoing mixture moves from the exhaust port 132 toward the exhaust system 150 (not shown in FIG. 2). The heat emitted by the continuing combustion of the outgoing mixture 138 causes the temperature of the exhaust system 150 to rise.

The piston 116 continues to move downward as shown in FIG. 2D. In the position shown, the engine is at bottom dead center. The exhaust port 132 is still unobstructed in this position, and the outgoing mixture 138 may continue to exit the cylinder 112 therethrough. Combustion of the outgoing mixture 138 may or may not continue, depending on the particulars of a given embodiment.

In addition, the transfer port 131 is now unobstructed, allowing an incoming mixture 136 to pass therethrough from the crank case 113 into the cylinder 112. Typically the incoming mixture 136 includes fuel, oil, and air.

The piston 116 then moves upward as shown in FIG. 2E. In the position shown, the engine is 90 degrees before top dead center. The exhaust port 132 is still unobstructed in this position, and the outgoing mixture 138 may continue to exit the cylinder 12 therethrough. As noted with respect to FIG. 2D, the outgoing mixture 138 may or may not continue to undergo combustion. Regardless, the transfer port 131 is now obstructed, so no more incoming mixture 136 may enter the cylinder 12 therethrough. However, an intake valve 133 in the intake port 130 opens, allowing the incoming mixture 131 to enter the engine 110 therethrough.

The piston 116 then continues to move upward to the point shown in FIG. 2A, and the cycle repeats.

Although as illustrated and described, the engine 110 is a two-cycle engine, this is exemplary only. Other engines, including but not limited to four-cycle engines, may be equally suitable.

In addition, although for simplicity only one cylinder 112 is shown in the engine 110 of FIG. 2, this is exemplary only. Engines with two or more cylinders may be equally suitable for use with the present invention.

Also, although as illustrated in FIGS. 2A through 2E, the intake valve 133 is a reed valve, this is exemplary only. Other valves may be equally suitable for use as the intake valve 133. Alternatively, in other arrangements it may not be necessary to include an intake valve 133 at all.

Furthermore, the description of certain parts in an engine suitable for use with the present invention should not be taken to imply the absence of other parts not so described. For example, additional valves, housings, etc. may be present.

In addition, it is noted that although the engine 110 as illustrated is of a design wherein the incoming mixture 136 is drawn into the cylinder 112 indirectly, i.e. via the crank case 113 and the transfer port 133, this is exemplary only. Other engine designs, including but not limited to designs wherein the incoming mixture 136 is drawn into the cylinder 112 directly from the intake port 130 without passing through a transfer port 133, may be equally suitable.

Although FIG. 2 shows a particular order and arrangement for ignition of the cylinder 112, i.e. in a warming position, it is emphasized that such an arrangement need not be exclusive. That is, the cylinder 112 may be ignited according to another arrangement, including but not limited to an operating position. In particular, other ignition positions for the cylinder 112 may include operating positions as previously known, i.e. the operating ignition position for the cylinder 112 may be similar to that of a conventional engine as shown in FIG. 1.

Figure 3:
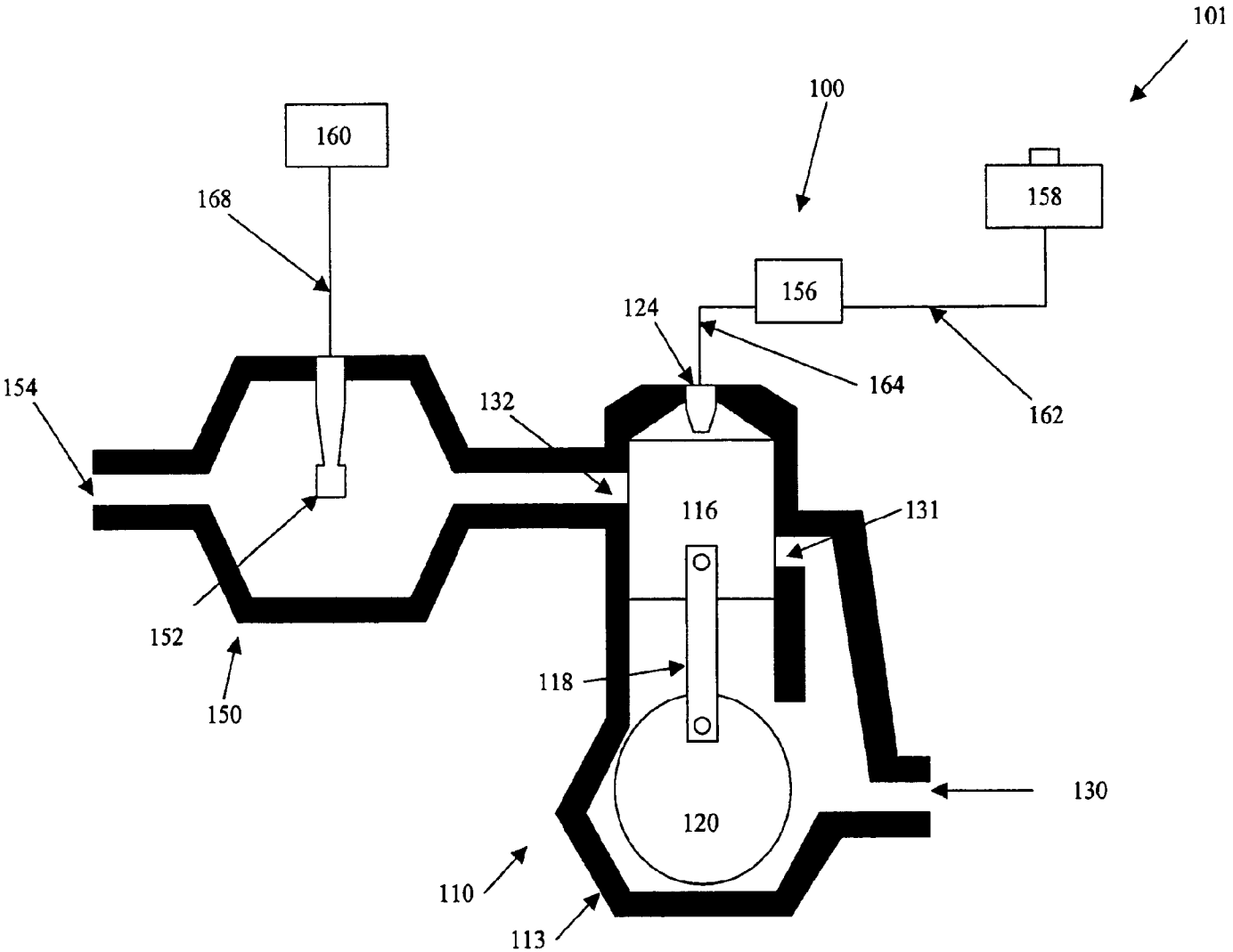
FIG. 3 shows in schematic form an exemplary embodiment of a manual engine control system in accordance with the principles of the present invention.

FIG. 3 shows an engine assembly 101 with an exemplary embodiment of a system 100 for controlling engine ignition in accordance with the principles of the present invention, an engine 110, and an exhaust system 150.

As shown, the engine 110 to which the control system 100 is connected includes a piston 116 disposed in a cylinder 112, the piston 116 being connected to a crank web 120 by way of a connecting rod 118. Fuel, air, etc. enter the cylinder 112 through the transfer port 131, to be ignited by the igniter 124 while in the cylinder 112. Exhaust gases, deoxygenated air, etc. exit the cylinder 112 through the exhaust port 132. These components and their operation are described above with respect to FIG. 2.

In addition, the engine 110 defines an intake port 130 therein. As previously noted, the intake port 130 passes an incoming mixture 136 (not shown in FIG. 3), i.e. fuel from the fuel system (not shown) into the engine 110. Depending on the particulars of a specific engine 110, the intake port 130 may also pass air and/or other substances. In addition, as may be seen, in the exemplary engine 110 shown in FIG. 3, the intake port 130 not only feeds to the cylinder 112, it also feeds to other components of the engine 110 such as those disposed within the crank case 113. In certain embodiments this may be desirable, for example in order to deliver a mixture of fuel and oil to the internal components of the engine so as to provide lubrication without a separate lubrication system. However, this is exemplary only, and other arrangements may be equally suitable.

As shown, the exhaust port 132 of the engine 110 is in communication with an exhaust system 150. The outgoing mixture 138 from the engine 110 passes through the exhaust system 150, exiting through the exhaust outlet 154. Exhaust systems per se are well known, and are not further described herein.

The system 100 itself includes an ignition changer 156 for changing the position at which the igniter 124 ignites the mixture of fuel and air in the cylinder 112.

The ignition changer 156 may take a variety of forms, depending on the particulars of a given embodiment. For example, the ignition changer 156 may include an integrated circuit to change the ignition position of the cylinder 112 from its position during normal operation of the engine 110. However, this is exemplary only, and other ignition changers 156 may be equally suitable.

The degree to which the ignition position is changed may vary from embodiment to embodiment. In addition, the degree to which the ignition position is changed may vary depending upon the circumstances, i.e. engine speed or temperature, ambient conditions, fuel mix, etc.

The ignition changer 156 may retard the ignition position from the normal operating ignition position for the engine, that is, ignition may occur later in the engine cycle than would otherwise be the case, as may be seen from a comparison of FIGS. 1 and 2. More particularly, the ignition changer 156 may change the ignition position of the cylinder 112 between a warming ignition position similar to that shown in FIG. 2 and an operating ignition position similar to that shown in FIG. 1.

The ignition changer 156 may retard the ignition position from the normal operating ignition position for the engine by up to 5 degrees.

The ignition changer 156 may retard the ignition position from the normal operating ignition position for the engine by at least 5 degrees.

The ignition changer 156 may retard the ignition position from the normal operating ignition position for the engine by at least 10 degrees.

The ignition changer 156 may retard the ignition position from the normal operating ignition position for the engine by at least 15 degrees.

The ignition changer 156 may retard the ignition position from the normal operating ignition position for the engine by at least 20 degrees.

The ignition changer 156 may retard the ignition position from the normal operating ignition position for the engine by at least 25 degrees.

The ignition changer 156 may retard the ignition position from the normal operating ignition position for the engine by at least 30 degrees.

The ignition changer 156 may retard the ignition position from the normal operating ignition position for the engine by at least 35 degrees.

The ignition changer 156 may retard the ignition position from the normal operating ignition position for the engine by at least 40 degrees.

It is noted that the normal operating ignition position for an engine 110 depends on the specifics of that particular engine 110. Conventionally, some engines may have an ignition position of 10 to 20 degrees before top dead center. Rather than defining the ignition position produced by the ignition changer 156 in terms of the difference between that ignition position and the normal operating ignition position, the change in engine position may also be determined in absolute terms rather than relative terms, i.e. as a particular position rather than as a change in position from the normal operating ignition position.

For example, the ignition changer 156 may retard the ignition position from the normal operating ignition position for the engine to a position of 10 to 20 degrees after top dead center, regardless of the normal operating ignition position.

The ignition changer 156 is in communication with the igniter 124. As illustrated, the ignition changer 156 is connected with the igniter 124 by wire 164. However, this is exemplary only.

The system 100 also includes an activator 158 for activating the ignition changer 156, so as to change the ignition position of the engine 110.

Figure 4:
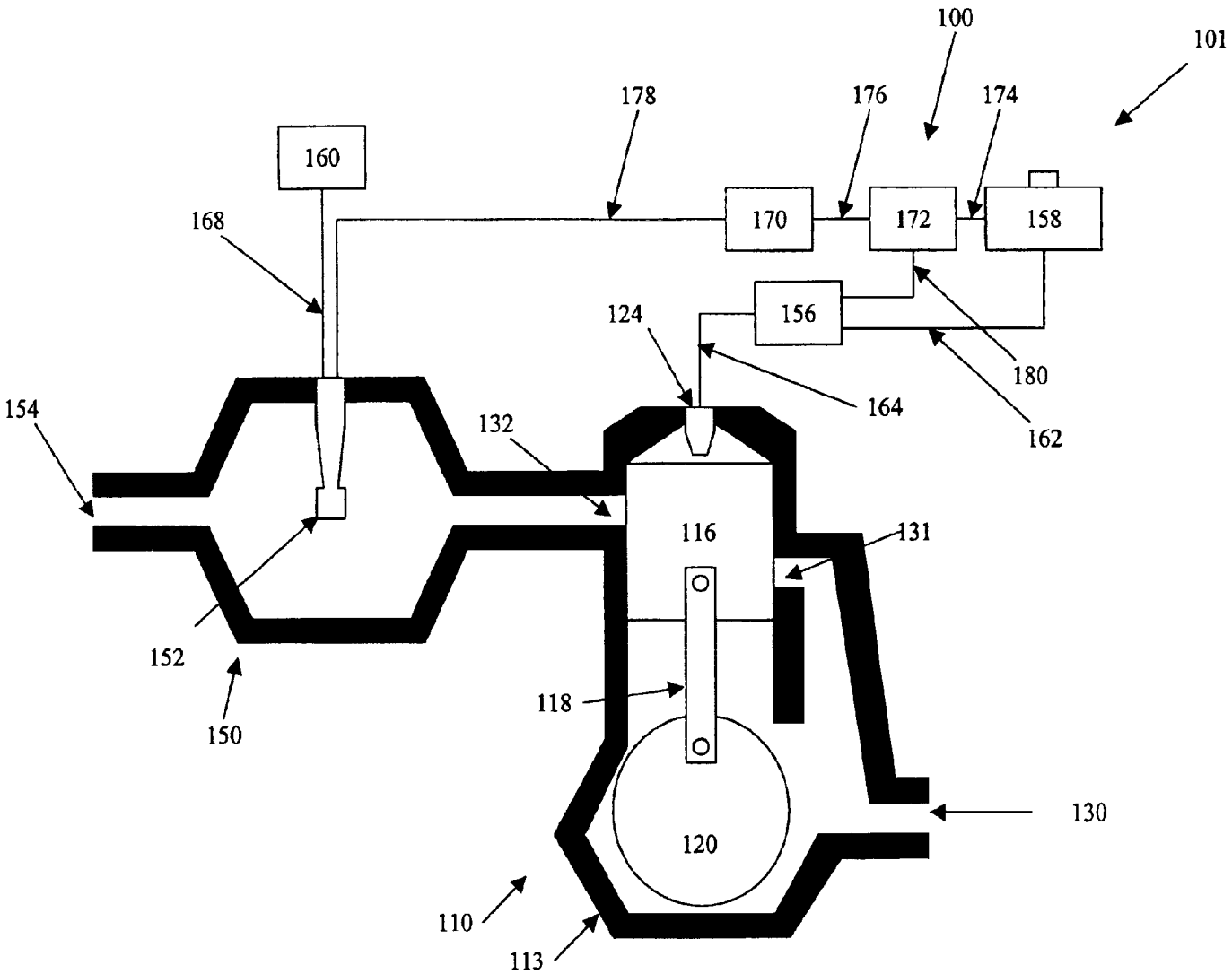
FIG. 4 shows in schematic form an exemplary embodiment of an automatic engine control system in accordance with the principles of the present invention.

The activator 158 may take a variety of forms. In particular, the activator 158 may be manual, as illustrated in FIG. 3, or automatic, as illustrated in FIG. 4.

Returning to FIG. 3, as shown therein the activator 158 is a manual activator. That is, the activator 158 is activated, deactivated, and/or adjusted only by the operator. For example, manual activators may include an on-off switch, wherein an operator manually turns the switch on to change the ignition position, and then manually turns the switch off to return the ignition position to the normal operating position.

However, such an arrangement is exemplary only, and other arrangements of manual activators may be equally suitable.

As shown in FIG. 3, the activator 158 is in communication with the ignition changer 156. As illustrated, the activator 158 is connected with the ignition changer 156 by wire 162. However, this is exemplary only.

The system 100 may include an exhaust sensor 152 for sensing the condition of the exhaust system 150.

A variety of exhaust sensors 152 may be suitable for use with the invention. For example, one or more temperature sensors disposed in, on, or near the exhaust system 150 may be used to measure the temperature of the exhaust system.

Such sensors may measure the temperature of the exhaust system 150 either directly, i.e. by contact with some portion of the exhaust system 150, or indirectly, i.e. by measuring the temperature of exhaust passing through the exhaust system 150. Suitable sensors are known per se, and are not described further herein.

Exhaust sensors 152 are exemplary only, and embodiments of the system 100 without an exhaust sensor 152 may be equally suitable.

In embodiments of the system 100 that include an exhaust sensor 152, the system may also include a display 160 for displaying the condition of the exhaust system 150 as sensed by the exhaust sensor 152 to the vehicle operator.

A variety of displays 160 may be suitable for use with the invention. For example, a gauge or readout indicating the temperature of the exhaust system 150 may be provided in a location accessible to the vehicle operator, i.e. on the vehicle's control panel. However, such an arrangement is exemplary only. Other displays 160, including but not limited to "idiot lights" indicating that the exhaust system 150 is or is not at a desired temperature, may be equally suitable.

The display 160 is in communication with the exhaust sensor 152. As illustrated, the display 160 is connected with the exhaust sensor 152 by wire 168. However, this is exemplary only.

As shown in FIG. 4, the activator 158 may be automatic. That is, the activator 158 may be activated, deactivated, and/or adjusted at least partially by the system 100.

An automatic activator may automatically change the ignition position so that the exhaust system 150 is always brought to its desired temperature whenever certain conditions are met.

For example, the system 100 may define two or more "maps" for operation of the engine 110. As used herein, the term "map" refers to a set of operating parameters for the engine 110, including but not limited to ignition position for the engine 110. Thus, the system 100 may define a first map used to determine proper operating parameters under various conditions when the engine 110 is being used to move the vehicle, a second map to determine operating parameters when the engine 110 is to be warmed, etc.

In an exemplary arrangement for automatic activation, the system 100 switches to a warm-up map (if not already using the warm-up map) in response to an instruction sent by the vehicle operator, i.e. when a switch is activated. The engine 110 then operates according to the warm-up map, i.e. with a retarded ignition position, until the desired temperature for the exhaust system 150 is reached. The system 100 may then return to a normal operation map. Depending on the embodiment, the system 100 may override attempts to activate it if the desired temperature has already been reached. For example, activating the switch again may not return the system 100 to the warm-up map.

In another exemplary arrangement for automatic activation, the system 100 also switches to a warm-up map in response to an instruction sent by the vehicle operator. The engine 110 operates according to the warm-up map, i.e. with a retarded ignition position, until the desired temperature for the exhaust system 150 is reached. The system 100 may then return to a normal operation map. However, the system 100 continues to monitor the temperature of the exhaust system 150, and automatically switches back to the warm-up map if the temperature of the exhaust system 150 drops below the desired temperature. Thus in such an embodiment, the system 100 would maintain the desired temperature for so long as the switch is activated by cycling between maps.

However, such arrangements are exemplar only. Other automatic activators 158 may be equally suitable, including but not limited to automatic activators that change the ignition position in response to an instruction sent by the operator, then return the ignition position to normal when a given interval of time has elapsed, or when the vehicle operator puts the vehicle in motion, or that automatically change the map (i.e. the ignition position) whenever the vehicle is started so that the exhaust system 150 is always brought to its desired temperature, may be equally suitable.

In addition, ignition maps are not limited only to parameters that control the temperature of the exhaust system 150. For example, for certain embodiments it may be desirable to limit engine RPM when the ignition position has been retarded, i.e. during engine warm-up, or when the vehicle transitions from the retarded ignition position to the normal operating ignition position. Thus, a map for changing ignition position may also change the number of ignition sparks per engine revolution, in order to limit engine RPM. Other features and parameters of engine and vehicle operation likewise may be included in maps.

FIG. 4 shows an exemplary arrangement wherein the activator 158 is an automatic activator that automatically changes the ignition position so that the exhaust system 150 is brought to its desired temperature in response to an instruction sent by the vehicle operator.

As with the manual arrangement illustrated in FIG. 3, in the automatic arrangement of FIG. 4 the ignition changer 156 are in communication with the igniter 124 and the activator 158, i.e. by wires 164 and 162 respectively. Likewise, the embodiment illustrated includes an exhaust sensor 152 and a display 160. However, this arrangement is exemplary only, and other arrangements may be equally suitable.

In addition, a system 100 with an automatic activator 158 may include a controller 172 for controlling the ignition changer 156. That is, in the embodiment described herein, when the activator 158 is activated, the controller 172 controls when, how, and how much the ignition changer 156 change the ignition position of the engine 110.

As shown, the controller 172 is in communication with the ignition changer 156, i.e. by wire 180 as illustrated.

Likewise, a system 100 with an automatic activator 158 may include a comparator 170 for comparing the condition of the exhaust system 150 as sensed by the sensor 152 with other data. The data may be predetermined data, such as a tuned temperature or other target temperature for the exhaust system 150. However, the data may also include data that is not predetermined, such as information regarding ambient conditions, i.e. the outside temperature, and/or other information regarding the vehicle, i.e. the engine speed, etc.

As shown, the comparator 170 is in communication with the sensor 152 and the controller 172, i.e. by wires 178 and 176 as illustrated.

For example, in the arrangement illustrated in FIG. 4, the comparator 170 receives signals from the exhaust sensor 152, indicating the temperature of the exhaust system 150. The comparator 170 compares the actual temperature of the exhaust system 150 to the desired or tuned temperature of exhaust system 150, and sends a signal to the controller 172. Based on the signal received from the comparator 170, the controller 172 then sends a signal to the ignition changer 156 as to when, how, and how much the ignition position of the engine 110 should be changed.

Suitable comparators 170 and controllers 172 include, but are not limited to, integrated circuits.

It is emphasized that this arrangement is exemplary only, and that other arrangements may be equally suitable.

In particular, at least some of the components illustrated individually in FIG. 4 may be integrated into a single unit. For example, in certain embodiments, the comparator 170, controller 172, and/or the ignition changer 156 may be formed as a single integrated circuit.

Furthermore, it is noted that not all of the components illustrated in FIG. 4 may be necessary for all embodiments of a system 100 with an automatic activator 158. For example, a system 100 without a display 160 may be equally suitable.

As previously noted with regard to FIG. 2, the heat emitted by the continuing combustion of the outgoing mixture 138 causes the temperature of the exhaust system 150 to rise. When the cylinder 112 is being ignited in its operating ignition position, as the temperature of the exhaust system 150 increases towards the tuned temperature of the exhaust system 150, the efficiency of the engine 110 tends to increase. Likewise, the peak power output of the engine 110 tends to increase. That is, the maximum power that the engine 110 can be made to provide increases; the power output of a given engine 110 will not necessarily be greater at all times when the temperature of the exhaust system 150 is at or near the tuned temperature, since the power output of the engine 110 commonly is variable at the discretion of the vehicle operator. Furthermore, the engine 110 quantity of pollutants produced by the engine 110 tends to decrease as the temperature of the exhaust system 150 increases towards the tuned temperature.

Figure 5:
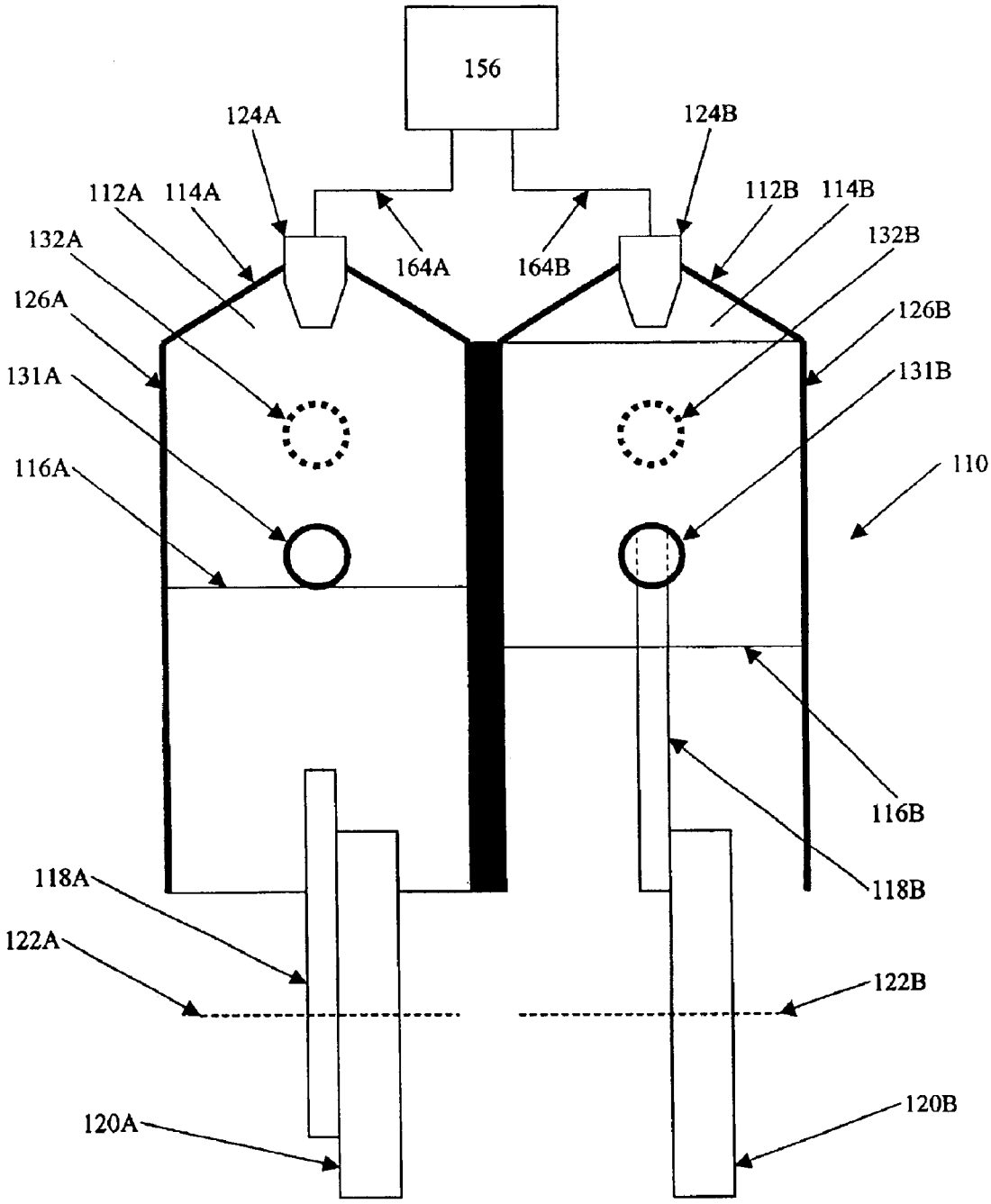
FIG. 5 shows in schematic form a portion of an exemplary embodiment of an engine control system in accordance with the principles of the present invention, as connected with a two-cycle engine having two cylinders.

For purposes of simplicity, FIGS. 2–4 show only one cylinder 112. However, this is exemplary only. FIG. 5 shows a portion of an exemplary engine 110 with two cylinders 112A and 112B.

The engine 110 includes components in association with cylinder 112A similar to those shown in FIG. 2. Thus, the engine 110 includes a cylinder head 114A, a piston 116A, a connecting rod 118A, a crank web 120A with an axis of rotation 122A, an igniter 124A, a cylinder wall 126A, a transfer port 131A, and an exhaust port 132A. Likewise, in association with cylinder 112B the engine 110 includes a cylinder head 114B, a piston 116B, a connecting rod 118B, a crank web 120B with an axis of rotation 122B, an igniter 124B, a cylinder wall 126B, an a transfer port 131B, and an exhaust port 132B.

For simplicity, not all of the components elsewhere illustrated and described as being present in an engine in accordance with the principles of the present invention, i.e. a crank case 113, are shown in FIG. 5.

In a preferred embodiment, when an engine 110 has two or more cylinders 112, the ignition changer 156 communicates with the cylinders in at least two groups, so as to ignite the groups independently.

In the arrangement shown in FIG. 5, pistons 116A and 116B are 180 degrees apart in their ignition cycles. Specifically, piston 116A is at bottom dead center, and piston 116B is at top dead center.

In conventional engines, it is known to ignite all cylinders simultaneously, so that each cylinder is ignited twice during its cycle, and to accept any anomalous combustion or other difficulties that this may produce. Indeed, in some conventional engines the ignition itself is at least partially integrated, i.e. a single ignition coil may be used to operate spark plugs for all of the cylinders.

However, in order to obtain the greatest advantage from the present invention, it is preferable to ignite the cylinders only at the appropriate ignition position. Thus, as illustrated in FIG. 5, the ignition changer 156 communicates separately with each of the igniters 124A and 124B, i.e. by wires 164A and 164B. In addition, each of the cylinders 112A and 112B has its own igniter, 124A and 124B. This enables the ignition changer 156 to activate igniters 124A and 124B independently from one another, so that each cylinder ignites only at the position desired (whether that ignition position is changed for heating the exhaust system 150, or is the normal operating ignition position).

Similarly, in engines 110 having more than two cylinders 112, it may be desirable for the ignition changer 156 to change the ignition position of the cylinders 112 in at least two independent groups, so that all of the cylinders 112 can be ignited only at the position desired. In certain embodiments, it may be desirable to ignite each cylinder 112 independently, and thus it may be desirable that the ignition changer 156 be adapted to change the ignition position of each cylinder 112 independently.

However, this is exemplary only. For some embodiments, not all cylinders 112 will be ignited independently from one another, and/or not all cylinders 112 will have their ignition positions altered independently. For example, if half of the cylinders 112 of an engine are arranged so that their ignition cycle is offset by 180 degrees from the ignition cycle of the other half of the cylinders 112 (i.e. in the manner that cylinder 112A is offset from cylinder 112B in FIG. 5), then all of the cylinders 112 can be ignited only at the position desired by igniting the cylinders 112 in only two independent groups. Thus, for such an arrangement, the ignition changer 156 might only change the ignition position of the cylinders 112 in two independent groups.

Although FIG. 2 shows the ignition cycle of the engine 110 with the ignition changed from the operating ignition position, and FIGS. 3 and 4 show engine assemblies 101 adapted for so changing the ignition of the engine 110 therein, it is emphasized that the engine control system 100 is not limited only to ignition that is changed from the operating ignition position. The engine control system 100 also may control the engine 110 so that ignition occurs in the normal operating ignition position, or in other ignition positions.

That is, embodiments of the engine control system 100 may be adapted to produce ignition of an engine 110 in both the operating ignition position and one or more changed ignition positions. The engine control system 100 enables operation of the engine 110 in one or more changed ignition positions for warming the exhaust system 150, but does not preclude operation at other ignition positions.

For example, an exemplary embodiment of the engine control system 100 may be suited for operating the engine 110 at a first or warming ignition position for warming the exhaust system 150, and also at a second or operating ignition position for normal operation of the engine 110. The engine could be operated initially at the warming ignition position until the exhaust system 150 reaches its tuned temperature, and then could be operated subsequently at the operating ignition position.

Furthermore, an engine assembly 101 adapted to change its ignition position in accordance with the principles of the present invention is not precluded from otherwise changing its ignition position. For example, the operating ignition position of an engine 110 under the control of an engine control system 100 in accordance with the principles of the present invention may vary even when the ignition position is not being changed to warm the exhaust system 150, i.e. the operating ignition position may vary somewhat depending on engine speed or other conditions.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method for improving engine performance, comprising:

in an engine assembly comprising an engine with at least one cylinder and a piston disposed within said cylinder, and an exhaust system, said cylinder being in communication with said exhaust system, manually activating ignition of said cylinder at a warming ignition position when a temperature of said exhaust system is lower than a target temperature of said exhaust system, wherein in said warming ignition position fuel and air propagate from said cylinder to said exhaust system while undergoing combustion, whereby said temperature of said exhaust system increases towards said target temperature; and manually activating ignition of said cylinder at an operating ignition position when said temperature of said exhaust system is at least equal to said target temperature, wherein a performance of said engine when said temperature of said exhaust system is at least equal to said target temperature is improved over a performance of said engine when said temperature of said exhaust system is less than said target temperature.

2. The method according to claim 1, wherein:

said engine is a two-cycle engine.

3. The method according to claim 1, further comprising:

cycling between said warming ignition position and said operating ignition position to maintain said temperature of said exhaust system at least equal to said target temperature.

4. The method according to claim 1, wherein:

said warming ignition position is retarded from said operating ignition position.

5. The method according to claim 4, wherein:

said warming ignition position is retarded from said operating ignition position by up to 5 degrees.

6. The method according to claim 4, wherein:

said warming ignition position is retarded from said operating ignition position by at least 5 degrees.

7. The method according to claim 4, wherein:

said warming ignition position is retarded from said operating ignition position by at least 10 degrees.

8. The method according to claim 4, wherein:

said warming ignition position is retarded from said operating ignition position by at least 15 degrees.

9. The method according to claim 4, wherein:

said warming ignition position is retarded from said operating ignition position by at least 20 degrees.

10. The method according to claim 4, wherein:

said warming ignition position is retarded from said operating ignition position by at least 25 degrees.

11. The method according to claim 4, wherein:

said warming ignition position is retarded from said operating ignition position by at least 30 degrees.

12. The method according to claim 4, wherein:

said warming ignition position is retarded from said operating ignition position by at least 35 degrees.

13. The method according to claim 4, wherein:

said warming ignition position is retarded from said operating ignition position by at least 40 degrees.

14. The method according to claim 4, wherein:

said warming ignition position is 10 to 20 degrees after top dead center.

15. The method according to claim 1, further comprising:

manually changing between said warming ignition position and said operating ignition position at any time and without respect to said temperature of said exhaust system.

16. The method according to claim 1, further comprising:

measuring said temperature of said exhaust system.

17. The method according to claim 16, further comprising:

displaying an indication of said temperature of said exhaust system to a vehicle operator.

18. The method according to claim 16, further comprising:

comparing said exhaust temperature with at least one comparison value using a comparator; and automatically changing between said warming ignition position and said operating ignition position in response to said comparison of said exhaust temperature with said comparison value.

19. The method according to claim 1, wherein said engine comprises at least two cylinders, further comprising igniting at least two of said cylinders independently from one another.

20. The method according to claim 1, wherein:

a rate at which said engine generates at least one pollutant decreases as said temperature of said exhaust system increases towards said target temperature when said engine is ignited at said operating ignition position.

21. The method according to claim 1, wherein:

a fuel efficiency of said engine increases as said temperature of said exhaust system increases towards said target temperature when said engine is ignited at said operating ignition position.

22. The method according to claim 1, wherein:

a peak power output of said engine increases as said temperature of said exhaust system increases towards said target temperature when said engine is ignited at said operating ignition position.

23. A method of decreasing output of at least one pollutant from an engine, comprising:

in an engine assembly comprising an engine with at least one cylinder and a piston disposed within said cylinder, and an exhaust system, said cylinder being in communication with said exhaust system, manually activating ignition of said cylinder at a warming ignition position when a temperature of said exhaust system is lower than a target temperature of said exhaust system, wherein in said warming ignition position fuel and air propagate from said cylinder to said exhaust system while undergoing combustion, whereby said temperature of said exhaust system increases towards said target temperature; and manually activating ignition of said cylinder at an operating ignition position when said temperature of said exhaust system is at least equal to said target temperature, wherein an output of at least one pollutant when said temperature of said exhaust system is at least equal to said target temperature is less than an output of said at least one pollutant when said temperature of said exhaust system is less than said target temperature.

24. A method of increasing fuel efficiency of an engine, comprising:

in an engine assembly comprising an engine with at least one cylinder and a piston disposed within said cylinder, and an exhaust system, said cylinder being in communication with said exhaust system, manually activating ignition of said cylinder at a warming ignition position when a temperature of said exhaust system is lower than a target temperature of said exhaust system, wherein in said warming ignition position fuel and air propagate from said cylinder to said exhaust system while undergoing combustion, whereby said temperature of said exhaust system increases towards said target temperature; and manually activating ignition of said cylinder at an operating ignition position when said temperature of said exhaust system is at least equal to said target temperature, wherein a fuel efficiency of said engine when said temperature of said exhaust system is at least equal to said target temperature is greater than a fuel efficiency of said engine when said temperature of said exhaust system is less than said target temperature.

25. A method of increasing a power output of an engine, comprising:

in an engine assembly comprising an engine with at least one cylinder and a piston disposed within said cylinder, and an exhaust system, said cylinder being in communication with said exhaust system, manually activating ignition of said cylinder at a warming ignition position when a temperature of said exhaust system is lower than a target temperature of said exhaust system, wherein in said warming ignition position fuel and air propagate from said cylinder to said exhaust system while undergoing combustion, whereby said temperature of said exhaust system increases towards said target temperature; and manually activating ignition of said cylinder at an operating ignition position when said temperature of said exhaust system is at least equal to said target temperature, wherein a peak power output of said engine when said temperature of said exhaust system is at least equal to said target temperature is greater than a peak power output of said engine when said temperature of said exhaust system is less than said target temperature.

26. An engine control system, comprising:

an ignition changer for changing an ignition position of a piston in at least one cylinder of an engine to and from a warming ignition position, wherein in said warming ignition position fuel and air propagate from said cylinder to an exhaust system while undergoing combustion, whereby said temperature of said exhaust system increases, said ignition changer being in communication with an igniter for said engine; and a manual activator for manually activating said ignition changer by an operator of the engine control system, said activator being in communication with said ignition changer.

27. The control system according to claim 26, wherein:

said warming ignition position is retarded from an operating ignition position for said engine.

28. The control system according to claim 27, wherein:

said warming ignition position is retarded from said operating ignition position by up to 5 degrees.

29. The control system according to claim 27, wherein:

said warming ignition position is retarded from said operating ignition position by at least 5 degrees.

30. The control system according to claim 27, wherein:

said warming ignition position is retarded from said operating ignition position by at least 10 degrees.

31. The control system according to claim 27, wherein:

said warming ignition position is retarded from said operating ignition position by at least 15 degrees.

32. The control system according to claim 27, wherein:

said warming ignition position is retarded from said operating ignition position by at least 20 degrees.

33. The control system according to claim 27, wherein:

said warming ignition position is retarded from said operating ignition position by at least 25 degrees.

34. The control system according to claim 27, wherein:

said warming ignition position is retarded from said operating ignition position by at least 30 degrees.

35. The control system according to claim 27, wherein:

said warming ignition position is retarded from said operating ignition position by at least 35 degrees.

36. The control system according to claim 27, wherein:

said warming ignition position is retarded from said operating ignition position by at least 40 degrees.

37. The control system according to claim 27, wherein:

said warming ignition position is 10 to 20 degrees after top dead center.

38. The control system according to claim 26, further comprising:

an exhaust sensor for sensing a temperature of said exhaust system.

39. The control system according to claim 38, further comprising:

a display for displaying an indication of said temperature of said exhaust system.

40. The control system according to claim 38, wherein:

said activator is an automatic activator, comprising:

a comparator for comparing said temperature of said exhaust system with at least one comparison value, said comparator being in communication with said exhaust sensing means; and a controller for automatically changing to and from said warming ignition position in response to said comparison of said exhaust temperature with said at least one comparison value, so as to automatically reach and maintain a target temperature for said exhaust system, said controller being in communication with said comparator and said ignition changer.

41. The control system according to claim 26, wherein:

said engine comprises at least two cylinders, each cylinder having a piston disposed therein, and said igniter is adapted to independently ignite at least two of said cylinders; and said ignition changer is adapted to change said ignition position of said pistons for said at least two independently ignited cylinders to and from said warming ignition position.

42. The control system according to claim 26, wherein:

a rate at which said engine generates at least one pollutant when said engine is ignited at an operating ignition position decreases as said temperature of said exhaust system increases towards a target temperature.

43. The control system according to claim 26, wherein:

a fuel efficiency of said engine when said engine is ignited at an operating ignition position increases as said temperature of said exhaust system increases towards a target temperature.

44. The control system according to claim 26, wherein:

a power output of said engine when said engine is ignited at an operating ignition position increases as said temperature of said exhaust system increases towards a target temperature.

45. A method of operating an engine, comprising:

in an engine assembly comprising an engine with at least one cylinder and a piston disposed within said cylinder, and an exhaust system, said cylinder being in communication with said exhaust system, manually activating ignition of said cylinder at a warming ignition position of said piston, such that fuel and air propagate from said cylinder to said exhaust system while undergoing combustion, whereby a temperature of said exhaust system increases towards a target temperature;

subsequently manually activating ignition of said cylinder at an operating ignition position of said piston different from said warming ignition position.

46. The method according to claim 45, wherein:

said engine is a two-cycle engine.

47. The method according to claim 45, wherein:

said cylinder is ignited at said warming ignition position at least until said temperature of said exhaust system reaches said target temperature.

48. The method according to claim 45, further comprising:

manually cycling between said warming ignition position and said operating ignition position to maintain said temperature of said exhaust system at least equal to said target temperature.

49. An engine assembly, comprising:

an engine, said engine comprising at least one cylinder, a piston disposed within said cylinder, and an igniter for igniting fuel and air within said cylinder;

an exhaust system in communication with said cylinder; and an engine control system, comprising:

an ignition changer for changing an ignition position of said piston to and from a warming ignition position, such that in said warming ignition position fuel and air propagate from said cylinder to said exhaust system while undergoing combustion, whereby a temperature of said exhaust system increases, said ignition changer being in communication with said igniter; and a manual activator for manually activating said ignition changer by an operator of the engine control system, said activator being in communication with said ignition changer.

50. The method according to claim 49, wherein:

said engine is a two-cycle engine.

* * * * *